United States Patent [19]

Lee et al.

[11] 4,212,240

[45] Jul. 15, 1980

[54] TRASH COMPACTOR

[75] Inventors: Harlan E. Lee; Lester W. Toelke, both of Houston, Tex.

[73] Assignee: International Tool & Supply Company, Inc., Houston, Tex.

[21] Appl. No.: 931,519

[22] Filed: Aug. 7, 1978

[51] Int. Cl.[2] ..... B30B 1/32

[52] U.S. Cl. ..... 100/53; 100/45; 100/52; 100/73; 100/218; 100/229 A; 100/255; 100/269 R; 100/295; 220/4 B

[58] Field of Search ..... 220/4 B, 4 E; 100/53, 100/229 R, 229 A, 52, 269 R, 295, 45, 73, 255; 60/456

[56] References Cited

U.S. PATENT DOCUMENTS

| | | | |
|---|---|---|---|
| 626,727 | 6/1899 | Shepherd | 100/229 R |
| 2,641,122 | 6/1953 | Cavagnaro | 100/229 A |
| 2,813,398 | 11/1957 | Wilcox | 60/456 |
| 2,938,347 | 5/1960 | Sturgis | 60/456 |
| 3,063,591 | 11/1962 | Laginestra | 220/4 B |
| 3,195,272 | 7/1965 | Mosher | 220/4 B |
| 3,386,601 | 6/1968 | Tezuka | 100/218 |
| 3,541,950 | 11/1970 | Anderson | 100/53 |
| 3,556,619 | 1/1971 | Bottas | 100/229 A |
| 3,608,476 | 9/1971 | Price | 100/218 X R |
| 3,636,862 | 1/1972 | Bottas | 100/229 A |
| 3,734,006 | 5/1973 | Hennells | 100/229 A |
| 3,800,694 | 4/1974 | Miller | 100/229 A |
| 3,808,967 | 5/1974 | Fair | 100/229 A |
| 3,831,513 | 8/1974 | Tashman | 100/229 A |
| 3,862,595 | 1/1975 | Longo | 100/229 A |
| 3,869,978 | 3/1975 | Steinberg | 100/229 A |
| 3,937,355 | 2/1976 | Engebretsen | 220/4 E |

FOREIGN PATENT DOCUMENTS

| | | | |
|---|---|---|---|
| 421060 | 8/1946 | Italy | 100/255 |

*Primary Examiner*—Billy J. Wilhite

*Attorney, Agent, or Firm*—Arnold, White & Durkee

[57] ABSTRACT

A trash compactor is especially designed for industrial and commercial usage. A compacting unit is driven by an electricity-free drive unit for allowing applications in hazardous environments, such as offshore drilling rigs. Specifically, a hydraulic pump is pneumatically driven for powering the compactor. A container used in the compactor is specially designed for facilitating removal of the relatively bulky and heavy compacted trash.

23 Claims, 7 Drawing Figures

TRASH COMPACTOR

BACKGROUND OF THE INVENTION

This invention relates generally to trash compactors and more particularly relates to apparatus for compacting trash in industrial or commercial applications, especially under hazardous operating conditions.

The ecology movement has focussed interests in several technological areas. One of these areas is the treatment and disposal of trash. One way of preliminarily treating the trash prior to ultimate disposal is compacting, wherein the trash is subjected to forces which compress and distill the trash into a compact and manageable form. Trash compactors have taken many forms and have been the subjects of many proposals for use in the home and business.

Trash compactors which have been suggested for home usage are generally lightweight units designed for light applications. Household type trash is relatively easy to compact, so consumer designs have focused on designs which are affordable by the consumer and which are sufficiently but not excessively rugged.

Commercial and industrial trash compactors are of a more heavyweight design than consumer versions. Because commercial and industrial trash is generally heavier and more resistant to compacting, there are design considerations for compacting with industrial and commercial compactors which are different from those considerations in designing consumer compactors.

In addition to the need for industrial and commercial compactors to be of a rugged design, it is desirable to have a design which will accommodate a high volume of trash. Also, in some applications there is a safety factor in that the environment may contain a hazard such as explosive vapors. Also, some industrial and commercial applications call for the compacted garbage to be bagged, as opposed to being stored in metal cans.

SUMMARY OF THE INVENTION

The present invention satisfies the demands of commercial and industrial trash compacting by providing a heavy duty compactor which is driven by an electricity-free drive unit and which is a design to allow the compacted trash to be disposed of in either bags or cans. A trash container according to the invention is designed especially to be used in association with bags such that removal of the filled bag is facilitated.

The heavy duty trash compactor according to one aspect of the invention includes a compacting unit and an electricity-free drive unit disposed in association with the compacting unit. The compacting unit includes a ram movably supported in association with a ram receiving container. The drive unit includes a hydraulic system having at least one hydraulic pump for forcefully advancing the ram into the container. The drive unit also includes a pneumatic system for driving the hydraulic pump, thereby providing electricity-free drive to the compacting unit.

In a preferred embodiment the ram includes a platen and a side member secured to the platen to define a reservoir. The drive unit is vertically disposed overlying the ram so that any inadvertant hydraulic leaks which may develop in the drive unit are accumulated in the reservoir.

In order to provide a low profile, the drive unit includes at least one telescopic cylinder having first and second telescopically disposed plungers for advancing the ram. Preferably, at least one guide having first and second telescopically disposed members is also provided for supporting the ram as it is advanced.

A safety catch is provided for maintaining the ram elevated when the ram is not in use. The safety catch includes a latch movable between latched and operating positions and which is disposed in association with the ram for maintaining the ram elevated when the latch is in the latch position. The latch is normally urged resiliently into the latched position and is advanced into the operating position when the ram is forcefully advanced by the drive unit past the latch and into the container.

The compacting unit includes a tray for supporting the container. The tray is supported on rollers and is pivotally disposed in association with the compacting unit for alternately advancing the container into a first position for receiving the ram and into a second position remote from the first position. In order to effect registry of the container on the tray, a guide structure is provided. The guide structure includes a locating pin and a set of blocks arranged on the tray. The locating pin is provided on the container, and the tray contains a locating pin receiving recess for receiving a pin when the container is in registry on the tray. Preferably, the tray is pivotally supported about a point on the periphery thereof such that the container is arcuately translated between the first and second positions.

As an outstanding feature of the invention, the container is of a novel design which facilitates removal of the trash. The container is comprised of first and second operatively connected members movable between open and closed positions. In the closed position the container defines a reservoir for supporting the trash during compacting. In the open position, the container is split to facilitate removal of the compacted trash.

Preferably the members are shaped to provide a bottom and an opening, with the bottom of the container supporting a hinge assembly for allowing the members to pivot between the open and closed position. The bottom member either supports structure or is itself of a structural configuration for urging both the first and second members into its respective open position in response to the weight of the compacted trash. This structure comprises a convex shaped assembly, with the apex of the assembly preferably being disposed substantially centrally on the bottom.

According to the invention, trash is compacted in commercial and industrial applications by placing the trash in a rigid container, generating hydraulic pressure using a hydraulic pump, advancing a ram into the container in response to the hydraulic pressure, and applying pneumatic pressure for driving the hydraulic pump, thereby powering the ram with the electricity-free drive. The method is ideally suited for practice in hazardous environments, such as on offshore and land drilling rigs.

It accordingly is a general object of the present invention to provide a new and improved heavy duty trash compactor which is particularly adapted to compacting industrial and commercial trash.

The above noted and other objects, advantages and features will become more apparent from reading the following detailed description of a preferred embodiment of the invention, in conjunction with the appended drawings.

FIGS. *2a–2e* are views of a container in accordance with the present invention.

Figure 1:
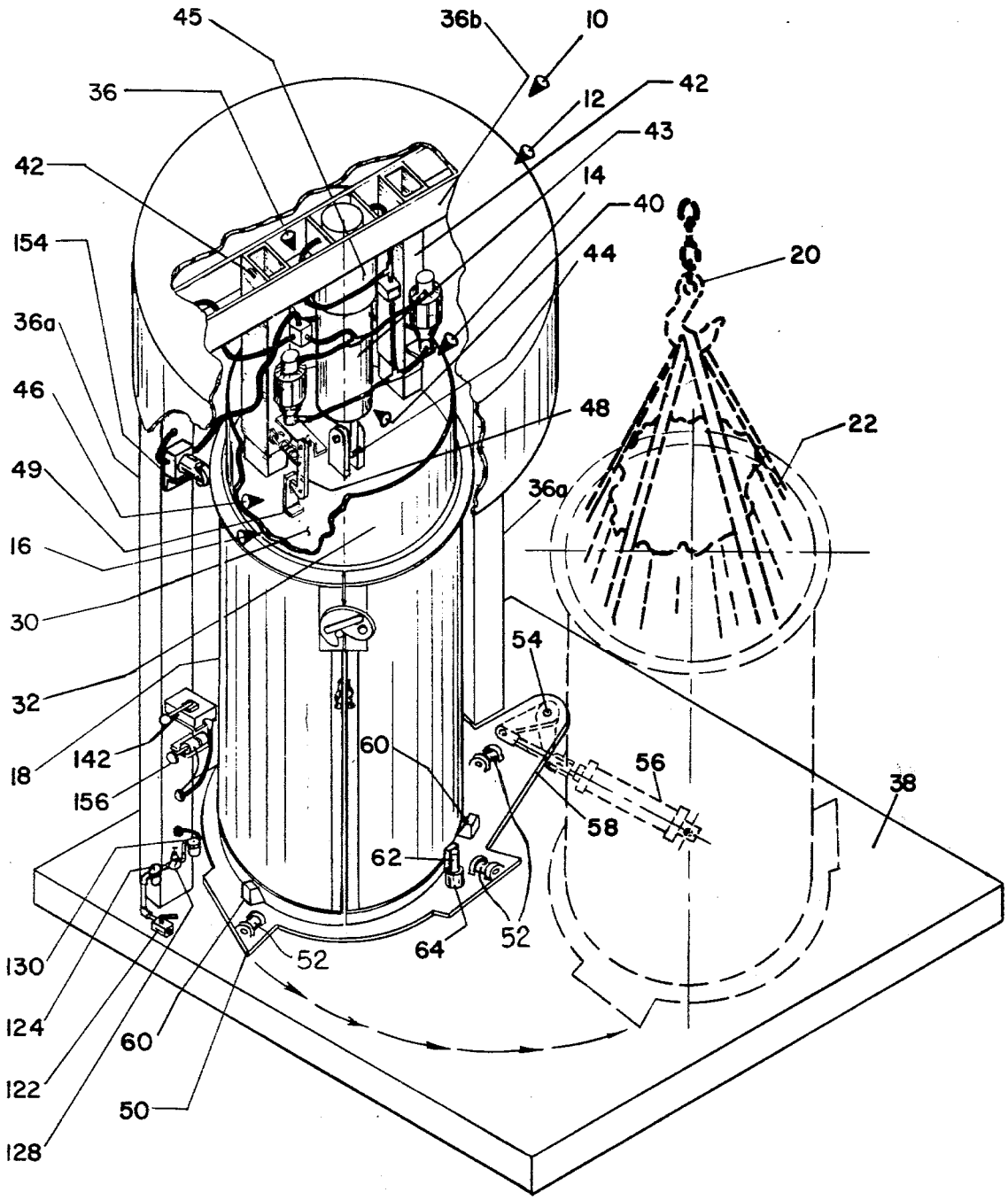
FIG. 1 is a perspective with a partial cut-away of a heavy duty trash compactor according to the invention.
Figure 2A:
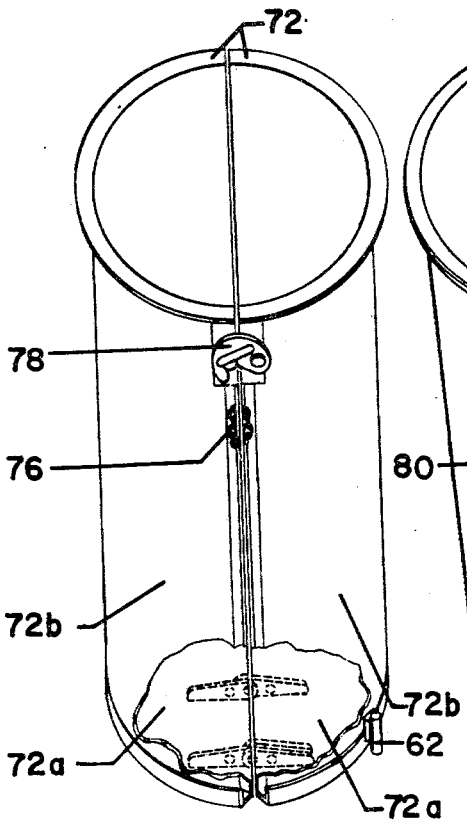
Figure 2B:
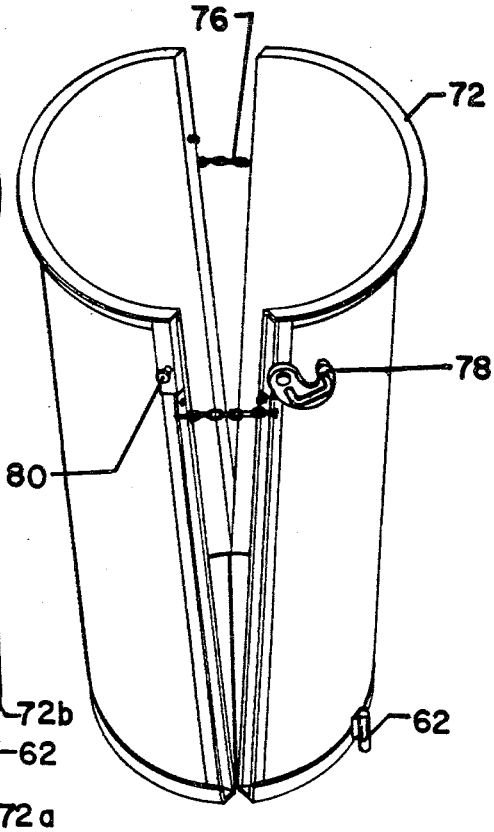
Figure 2C:
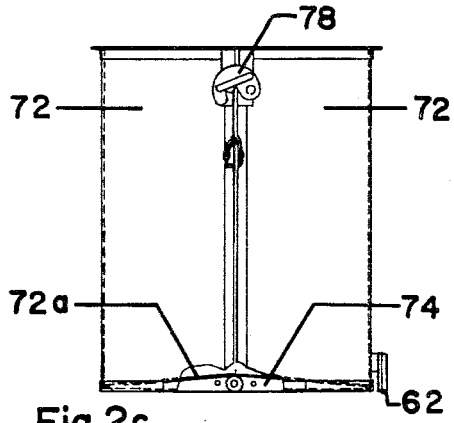
Figure 2D:
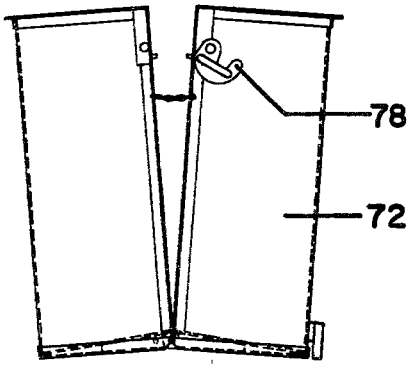
Figure 2E:
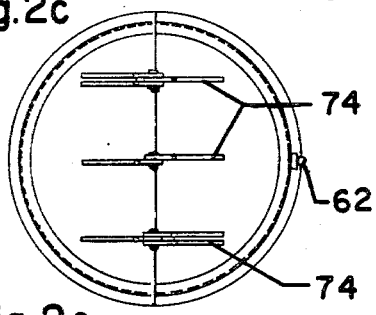
Figure 3:
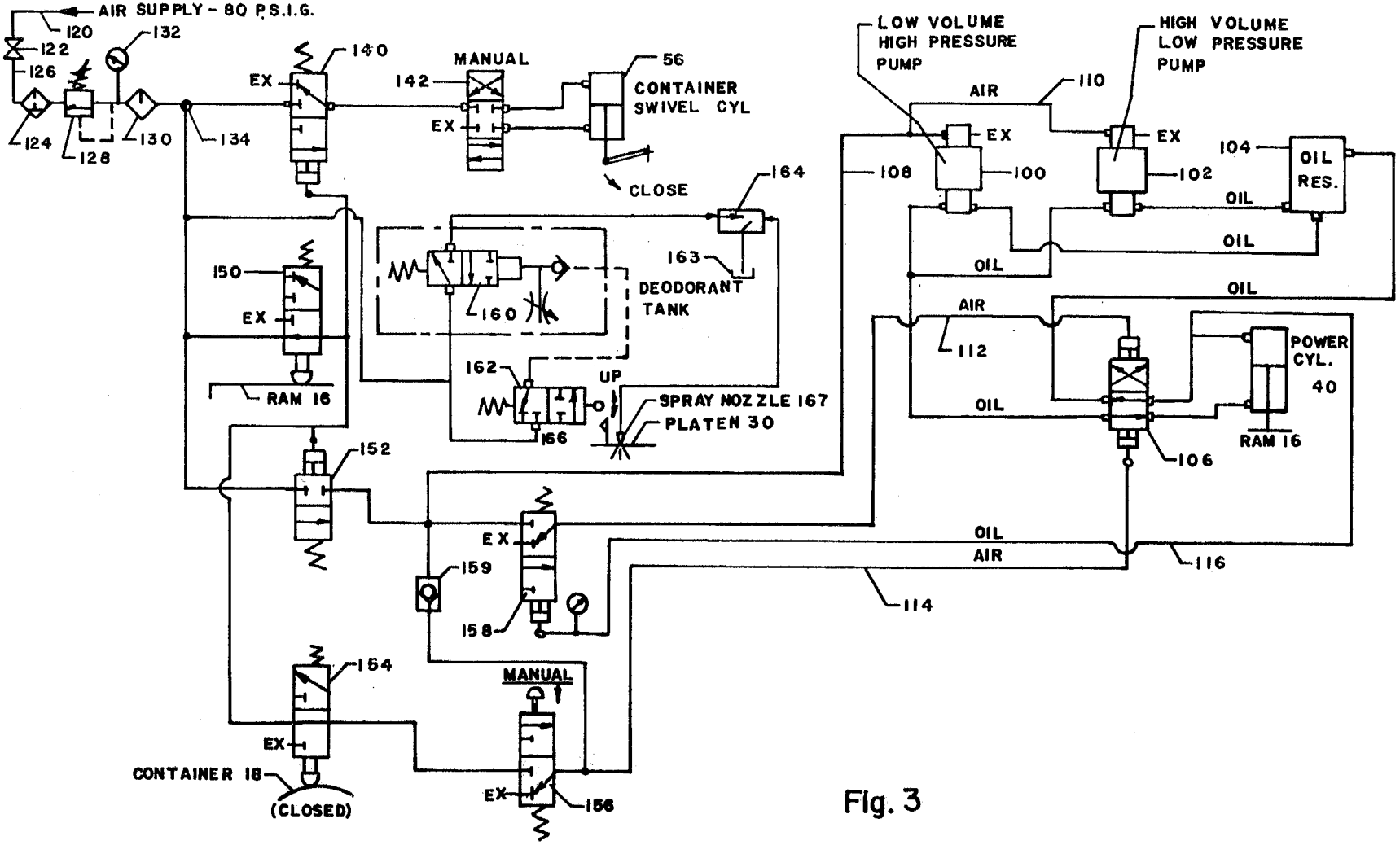

FIG. 3 is a circuit schematic of the hydraulic/-pneumatic system utilized for operating the trash compactor or FIG. 1.

DETAILED DESCRIPTION OF A PREFERRED EMBODIMENT

A heavy duty trash compactor 10 is schematically shown in FIG. 1. The compactor 10 is particularly designed for treating industrial and commercial trash, such as garbage, refuse, light industrial and commercial tailings, and the like. The compactor 10 is designed to allow use in hazardous environments; for example in potentially explosive environments such as on a drilling rig. The compactor 10 is also of a design to facilitate removal of the compacted trash, which usually is relatively heavy and inconvenient for a single man to handle. The compactor 10 is designed to allow either bagged trash or canned trash.

The compactor 10 includes a compacting unit 12 and an electricity-free drive unit 14 disposed in association with the compacting unit. The drive unit 14 utilizes hydraulic and pneumatic systems for driving the compacting unit without relying on electricity. An electricity-free trash compactor is particularly attractive in potentially explosive applications.

The compacting unit 12 includes a ram 16 which is movably supported in association with a ram-receiving container 18. The drive unit 14 forcefully advances the ram 16 into the container 18 for compacting trash which is previously placed in the container 18.

In the preferred and illustrated embodiment, the drive unit 14 produces a force in the neighborhood of 42,000 pounds. With a ram 16 having a trash engaging surface area with a three foot diameter, the compacting unit 12 should exert a force on the trash on the neighborhood of forty pounds per square inch.

After the compacting unit has compacted the trash in the container 18, a removal mechanism 20 is provided for removing the trash from the compacting unit 12. The removal mechanism 20 preferably takes the form of a hoist having a connecting mechanism such as a hook which is manually secured to the canned or bagged trash for conveying it to a transport station. A bag 22 is indicated in FIG. 1 in association with the container 18 when bagged trash is desired.

Referring again to FIG. 1, the ram 16 includes a platen 30 and a side member 32 upstandingly secured to the platen such as by weldments. The platen 30 and the upstanding side member 32 define a reservoir. The drive unit 14 is vertically disposed overlying the reservoir so that inadvertent leaks and other malfunctions will allow hydraulic fluid to be contained in the reservoir. This is a highly desirable feature in line with ecology demands of today.

In the preferred and illustrated embodiment, the platen 30 has a three foot diameter for exerting the necessary compacting forces on trash within the container 18.

The compacting unit 10 includes support structural 36 including a pair of upstanding side members **36*a* and a cross member 36*b*. The members 36*a* are secured to a skid 38 which also serves to support the container 18** as will subsequently be described.

The drive unit 14 is secured to and acts against the cross member **36*b*. The drive unit 14 includes a hydraulic system which is operated in response to hydraulic and penumatic pressure. The hydraulic system includes a cylinder 40 coupled between the cross member 36*b* and the top side of the platen 30. The platen 30 is also coupled to the cross member 36*b* by a pair of guides 42 which assist in the definition of travel of the ram 16 as it is operated. Preferably, the cylinder 40 is a telescoping cylinder, having in effect dual plungers 43, 44 which are nested inside a cylinder housing 45. The inner most plunger 44 is connected to the platen 30. Similarly, the guides 42** are preferably telescoping so that an overall relatively low profile design is effected.

The hydraulic and pneumatic circuits for operating the cylinder 40 is shown in detail in FIG. 3 and will be discussed subsequently.

A safety catch 46 is disposed in association with one of the side members **36*a*. The catch 46 includes a latch plate 49 and a pivotally supported arm 48 which is resiliently urged into the down or compacting path of the platen 30 when the platen 30 is elevated and inactive. The arm 48 then engages the latch plate 49. This serves as a safety mechanism for assuring that the ram 16 does not inadvertently fall upon malfunction of the drive unit 14. On the other hand, when the ram 16 is driven downwardly by the unit 14, the ram generates enough force on the arm 48 to overcome the force tending to hold the arm engaged with latch plate 49, thereby unlatching the arm 48 and plate 49**.

The container 18 is preferably supported on a tray 50 which itself is supported on the skid 38 by a set 52 of rollers. The tray 50 is pivotally supported at 54 to the skid 38 at a peripheral portion of the tray 50. A hydraulic, container swivel cylinder 56 is coupled to the skid 38 and to the tray 50 by a flange 58. Upon actuation of the cylinder 56 by hydraulic circuitry shown in more detail in FIG. 3, the tray 50 is pivoted about an arc from a first position underneath the ram 16 to a second position remote therefrom. This is indicated in phantom in FIG. 1.

The pivotal connection of the tray 50 at the location 54 to effect the arcuate movement of the tray is a feature of the invention in that it allows use of a cylinder 56 having a relatively short stroke. That is, a relatively small movement of the plunger of the cylinder 56 effects a relatively large movement of the tray 50 and thus of the container 18. This facilitates loading and unloading of the container 18.

The container 18 is positioned into registry on the tray 50 by a set of guides 60. The guides 60 are positioned around the periphery of the bottom of the container 18 and have a bevelled inner surface for effecting registration of the container 18 as it is lowered onto the tray 50.

As another feature of the invention, a locating pin 62 is provided relative to the container 18 and the tray 50. This allows the container 18 to consistently be positioned onto the tray 50 in a predetermined orientation. This is advantageous in that it facilitates operation of the system when the opening of the container 18 becomes out of round. Or, often times, when the container is manufactured the opening of the container is out of round. By orienting the container using the pin structure 62, it assures that the container is placed at an orientation that the ram 16 does not engage the end of the container and cause a malfunction.

In the preferred and illustrated embodiment, the container 18 supports the pin 62, and the tray 50 defines a pin-receiving hole 64.

Referring now to FIG. *2a–2e*, the container 18 preferably is comprised of a pair of members 72. The members 72 each include a base portion 72*a* and side portions 72*b* upstanding from the base portion 72*a*. The side portions 72*b* are configured as half-cylinders such that when the members 72 are fitted together, a generally cylindrical container is defined having an open end and a closed end.

The members 72 are coupled together by a set of hinges 74 located on the base portions 72*a*. This allows the members 72 to pivot about the axis defined by the hinges 74 such that the opening is of a relatively small area when the container is closed and is of a relatively large area when the container is open. This facilitates in removal of the compacted trash.

A chain 76 is coupled to each of the side portions 72*b* to limit separation of the members 72*b* when the container is open for trash removal.

A latch 78 is coupled to one of the side portions 72*b* and is securable to a pin 80 on the other of the side portions 72*b* for maintaining the container in the closed position during compacting.

As a feature of the invention, the base portions 72*a* of the members 72 do not lie in a plane when the container is closed. Instead, as is shown most clearly in FIG. *2c*, the base portions 72*a* are at an incline to define a convex base. This structure is in the shape of an isosceles triangle or inverted V and preferably has the apex substantially centrally located on the base.

This non-planar base is a feature especially when bags are used within the container 18. It facilitates removal of the bagged trash after compacting by allowing the weight of the compacted trash to force the side portions 72*b* into the open position when the latch 78 is released. Otherwise, because the trash is relatively heavy and voluminous, a single man may have difficulty in manipulating the container into the open position.

The degree of incline of the base members is selected such that not too much force is exerted on the latch 78 when it is in the closed position, yet enough force to thrust the side portions 72*b* into the open position when the latch is released.

Referring now to FIG. 3 the hydraulic circuity comprising the drive unit 14 for operating the ram 16 is shown. The cylinder 40 is hydraulically operated in response to operation of a low volume high pressure pump 100 and a high volume low pressure pump 102. Oil which is stored in a reservoir 104 is provided under pressure to the cylinder 40 in response to actuating of a valve 106. Actuation of the pumps 100, 102 is controlled in response to airlines 108, 110, respectively. Operation of the valve 106 is controlled in response to a pair of airlines 112 and 114. Thus, the hydraulic system which provides the driving power to the cylinder 40 is itself actuated by an electricity-free pneumatic system via the lines 108–114.

Referring additionally to FIG. 3, air is provided to the pneumatic system by an air hose 120. In the preferred and illustrated embodiment, air is provided in the line 120 at a pressure of 80 p.s.i.g. The line 120 is connected to a valve switch 22 which in turn is coupled to a filter 124 by an air line 126. A regulator 128 and an air line oiler 130 are provided. A pressure gauge 132 is provided at the input of the oiler 130, and the output of the oiler 130 is connected to a node 134. The node 134 is connected by a normally closed safety valve 140 to a normally closed manual valve 142 which controls operation of the cylinder 56. Whenever the platen is in the up or raised position, the valve 140 is enabled such that operation of the manual valve 142 allows the cylinder 56 alternately to pivot the tray to positions remote from and under the ram 16.

The node 134 is also connected to a normally closed safety valve 150. The valve 150 is located on the cross-member 36*b* to detect when the ram 16 is in the elevated position. The output of the valve 150 is connected to the valve 140 such that when the ram 16 is in the raised position, operation of the cylinder 56 is enabled.

The output of the safety valve 150 is also connected to a normally open valve 152 and to a second normally closed safety valve 154. The output of the valve 152 is connected to the airline 108 and to a normally open pressure sensing valve 158. The output of the valve 158 is connected to the airline 112. The valve 158 is actuated in response to hydraulic pressure provided to the cylinder 40 via the hydraulic line 116. The valve 154 is located on structure on the side members 36*a* for detecting when the container 18 has been pivoted into the closed position, i.e. into the position underlying the ram 16. The output of the safety valve 154 is coupled to a normally closed manually operated cycle switch valve 156. When the ram 16 is in the elevated position and the container is under the ram 16, the switch valve 156 is enabled, allowing operation of the hydraulic system. That is, if the normally closed safety valve 150 has been operated to provide pressure to the valve 152, pressure may be provided to the lines 108 and 112. This depends upon whether the valve 156 has been actuated and whether the pressure sensing valve 158 has been actuated.

In more detail, the valve 158 is coupled to monitor the oil pressure provided to the cylinder 40. The valve 158 closes when the hydraulic pressure exceeds a predetermined value, in the illustrated embodiment 1200 p.s.i.g. After the manually operated valve 156 has been actuated, air pressure is provided on the lines 108, 112 and 114 for operating the sytem.

A system for providing deodorizing spray to the container is also provided. The node 134 is connected to a pair of valves 160, 162. A deodorant tank 163 is provided for holding the deodorizing fluid, and a valve 164 couples the tank 163 to a mechanical switch 166. The switch 166 is provided for detecting position of the platen 30. Actuation of the switch 166 operates the valve 162 which in turn actuates the valve 160, allowing deodorant siphoned by valve 164 from the tank 163 to be sprayed onto the garbage as the ram 16 ascends.

Operation of the compacting unit 10 is as follows. Assuming the unit 10 is in the normal or at rest position with the ram 16 elevated, the states of the various components are as follows. The valve 140 is open due to pilot pressure from the valve 150. The valve 142 is closed and the cylinder 56 is in the closed position such that the container is underlying the ram. The valve 150 is open as the ram in the elevated position holds it open. The valve 154 is open, as the container holds it open and passes pressure obtained from the valve 150. The valves 156, 158 are closed. The valve number 159 is static due to there being no flow. The valve 106 is open to pass the oil pressure which retracts the lift side of the power piston in the cylinder 40. The cylinder 40 is retracted with no flow being in the pumps 100, 102.

In order to start a compacting cycle, the operator manually depresses the plunger on the manual valve 156. He holds it the valve 156 in actuation for approximately two seconds to allow the pumps 100, 102 to run before releasing. This two second interval also gives the time for the valves to sequence.

The operator then releases the plunger of the manual valve 156, allowing it to return to its closed position. The valves 140, 142 and the cylinder 56 are not effected and the container 18 remains in the closed position.

The pumps 100 and 102 operate due to pressure being provided from the valve 152. The cylinder 40 begins to descend and extends to either the end of the stroke or until the oil pressure increases to a predetermined level, in this case 1200 p.s.i.g. When this pressure is detected, the valve 158 opens causing pressure to be provided to the line 112 for operating the valve 106. This causes the cylinder 40 to begin retracting, and the ram 16 ascends. When pressure to the cylinder 40 drops below 1200 p.s.i.g. on the return stroke, the valve 158 closes. Since there is no pilot pressure on either side of the valve 106, it is not effected by the closure of the valve 158 so it remains in the position corresponding to raising of the ram 16.

As the ram ascends, the switch 166 detects the raising of the ram, operating the valve 162 which introduces pressure into the timer valve 160. The timer valve 160 opens, providing pressure to valve 164. Deodorant is syphoned from the tank 163 via the valve 164 and ejected by a spray nozzle 167 through an aperture in the platen 30 and thus onto the contents of the container as the ram ascends. After the preset time elapses, the timer valve 160 closes, cutting out the spray.

When the ram 16 reaches the retracted or up position, the safety valve 150 opens. Pilot pressure is introduced to the valve 152 causing it to close. Therefore, pressure is discontinued to the pumps 100, 102, causing them to stop. The machine is now in its normal or at rest position.

It will thus be appreciated that a new and improved trash compactor has been described which is particularly attractive for industrial and commercial applications. Use of an electricity-free drive unit for providing the compacting forces makes the unit particularly attractive for use in hazardous operating conditions. The novel trash container used in the compactor facilitates removal of the compacted trash.

Although a rather detailed embodiment of the present invention has been described herein, it is understood that it is by way of example only. Numerous changes and modifications will be apparent to those of ordinary skill in the area without departing from the inventive concept as disclosed herein.

What is claimed is:

1. A heavy dhuty trash compactor comprising:

a compacting unit, including a ram movably supported in association with a ram-receiving container, for compacting trash disposed within the container; and an electricity-free drive unit disposed in association with the compacting unit for forcefully advancing the ram into the container, the drive unit including a hydraulic system having at least one hydraulic pump for propelling the ram by hydraulic force and a pneumatic system for controllably applying gas under pressure for driving the hydraulic pump, thereby providing electricity-free drive to the compacting unit; and a safety latch movable between latched and operating positions and disposed in association with the ram for maintaining the ram remote from the container when the latch is in the latched position, said latch normally being resiliently urged into said latched position and being advanced into said operating position when said ram is forcefully advanced by the drive unit into the container.

2. The trash compactor of claim 1 wherein the ram includes a platen and a side member secured to the platen to define a reservoir, and wherein said drive unit is vertically disposed overlying said ram so that hydraulic leaks are accumulated in said reservoir.

3. The trash compactor of claim 1 wherein said drive unit includes a telescopic cylinder having first and second telescopically disposed plungers for advancing the ram.

4. The trash compactor of claim 3 wherein said drive unit further includes at least one guide having first and second telescopically disposed members for supporting the ram as it is advanced.

5. The trash compactor of claim 1 wherein the compacting unit further includes a tray for supporting the container, a skid being pivotally supported for alternately advancing the container into a first position for receiving the ram and into a second position remote therefrom.

6. The trash compactor of claim 5 and including a guide supported on said tray for registering the container into alignment on the tray.

7. The trash compactor of claim 6 wherein the guide and the container include a locating pin and associated recess for receiving the pin when the container is in registry on the tray.

8. The trash compactor of claim 7 wherein the recess is in said tray.

9. The trash compactor of claim 5 wherein the tray is pivotally supported about a point on the periphery thereof such that the container is arcuately translated between the first and second positions.

10. The trash compactor of claim 1 wherein said container includes first and second operatively connected members movable between open and closed positions, in the closed position the container defining a reservoir for supporting the trash during compacting, and in the open position the container being split to facilitate removal of the compacted trash.

11. The trash compactor of claim 10 wherein the first and second members define an opening for receiving the ram and define a bottom opposite the opening, the bottom supporting a means for allowing the members to pivot between said open and closed positions.

12. The trash compactor of claim 11 and including mechanical means for removing the compacted trash throgh said opening.

13. The trash compactor of claim 11 wherein substantially equal portions of said first and second members define said bottom.

14. The trash compactor of claim 1 and including a bag disposed in said container whereby said ram advances into said bag.

15. An improved container especially adapted for use in a heavy duty trash compactor, comprising:

(a) at least first and second shaped members which in combination define a base and sides upstanding from the base to form an opening opposite the base, thereby to define a reservoir, the members being movably connected to one another at the base to enable each member to be moved respectively from a closed position to an open position, the members in the closed position defining a relatively small volume during compacting and the members in the open position defining a relatively large volume to facilitate removal of the trash through the opening after compacting;

(b) means movably connecting said members to allow both members to be moved from its respective closed position to its respective open position;

(c) a lock for selectively maintaining the members in the closed position upon engagement of the lock; and (d) structure extending from the base within the reservoir for causing the compacted trash to urge the members into the open position after the lock has been disengaged.

16. The container of claim 15 and including means for limiting movement of the members away from the respective closed positions, thereby establishing said open positions.

17. The container of claim 15 wherein the structure is in the shape of an inverted "V", with the apex of the "V" disposed substantially in the center of the base.

18. The container of claim 17 and including means on at least one of the members for registering the container with respect to the trash compactor.

19. The container of claim 15 wherein said connecting means comprises a hinge.

20. The container of claim 15 and including a bag disposed within said first and second shaped members.

21. A heavy duty trash compactor comprising:

a compacting unit, including a ram movably supported in association with a ram-receiving container, for compacting trash disposed within the container and having a tray for supporting the container, a skid being pivotally supported or alternately advancing the container into a first position for receiving the ram and into a second position remote therefrom;

an electricity-free drive unit disposed in association with the compacting unit for forcefully advancing the ram into the container, the drive unit including a hydraulic system having at least one hydraulic pump for propelling the ram by hydraulic force and a pneumatic system for controllably applying gas under pressure for driving the hydraulic pump, thereby providing electricity-free drive to the compacting unit; and a guide supported on said tray for registering the container into alignment on the tray, said guide including a set of blocks arranged on the tray wherein the tray is supported on a set of rollers.

22. A heavy duty trash compactor comprising:

a compacting unit, including a ram movably supported in association with a ram-receiving container, for compacting trash disposed within the container, said container including first and second operatively connected members movable between open and closed positions, in the closed position, the container defining a reservoir for supporting the trash during compacting, and in the open position the container being split to facilitate removal of the compacted trash, said first and second members defining an opening for receiving the ram and defining a bottom opposite the opening, said bottom supporting a means for allowing the members to pivot between said open and closed position, said bottom having structure for urging both said first and second members into respective open positions in response to the weight of the compacted trash; and an electrically-free drive unit disposed in association with the compacting unit for forcefully advancing the ram into the container, the drive unit including a hydraulic system having at least one hydraulic pump for propelling the ram by hydraulic force and a pneumatic system for controllable applying gas under pressure for driving the hydraulic pump, thereby providing electricity-free drive to the compacting units.

23. The trash compactor of claim 22 wherein said structure comprises a convex shaped assembly, with the apex of the assembly being disposed substantially centrally on the bottom.

* * * * *

UNITED STATES PATENT AND TRADEMARK OFFICE

CERTIFICATE OF CORRECTION

PATENT NO. : 4,212,240

DATED : July 15, 1980

INVENTOR(S) : Harlan E. Lee et al.

It is certified that error appears in the above-identified patent and that said Letters Patent are hereby corrected as shown below:

Column 2, line 62, "to" should be --for--;
Column 5, line 66, "22" should be --122--;
Column 7, line 57, "dhuty" should be --duty--;
Column 8, line 57, "throgh" should be --through--.

Signed and Sealed this

*Fourteenth* Day of *October 1980*

[SEAL]

*Attest:*

SIDNEY A. DIAMOND

*Attesting Officer*

*Commissioner of Patents and Trademarks*